United States Patent [19]

Groeschel

[11] 4,023,456

[45] May 17, 1977

[54] MUSIC ENCODING AND DECODING APPARATUS

[76] Inventor: Charles R. Groeschel, 2402 Ansbury, Houston, Tex. 77018

[22] Filed: July 5, 1974

[21] Appl. No.: 485,983

[52] U.S. Cl. ..... 84/115; 84/462

[51] Int. Cl.[2] ..... G10F 3/00; G10G 3/04

[58] Field of Search ..... 84/1.01, 1.03, 115, 84/462, 470

[56] References Cited

UNITED STATES PATENTS

| | | | |
|---|---|---|---|
| 3,683,096 | 8/1972 | Peterson et al. | 84/115 |
| 3,771,406 | 11/1973 | Wheelwright | 84/470 X |
| 3,789,719 | 2/1974 | Maillet | 84/115 |
| 3,868,882 | 3/1975 | Fukui et al. | 84/462 |
| 3,872,766 | 3/1975 | Fukui | 84/115 |

*Primary Examiner*—Stanley J. Witkowski
*Attorney, Agent, or Firm*—Donald Gunn

[57] ABSTRACT

Music encoding and decoding apparatus which divides a keyboard instrument into groupings of designated lengths such as octaves wherein each octave is scanned, either in sequence or on triggering of a key in that octave; the apparatus includes a master encoder which encodes a key closure, the encoding being in the form of a word of multiple bits having a specified word length. The apparatus further encodes the expression of the note. The expression constitutes a portion of the word. Decoding apparatus is likewise incorporated. It reverses the sequence and drives a solenoid for operation of a keyboard instrument.

19 Claims, 9 Drawing Figures

FIG. 1A
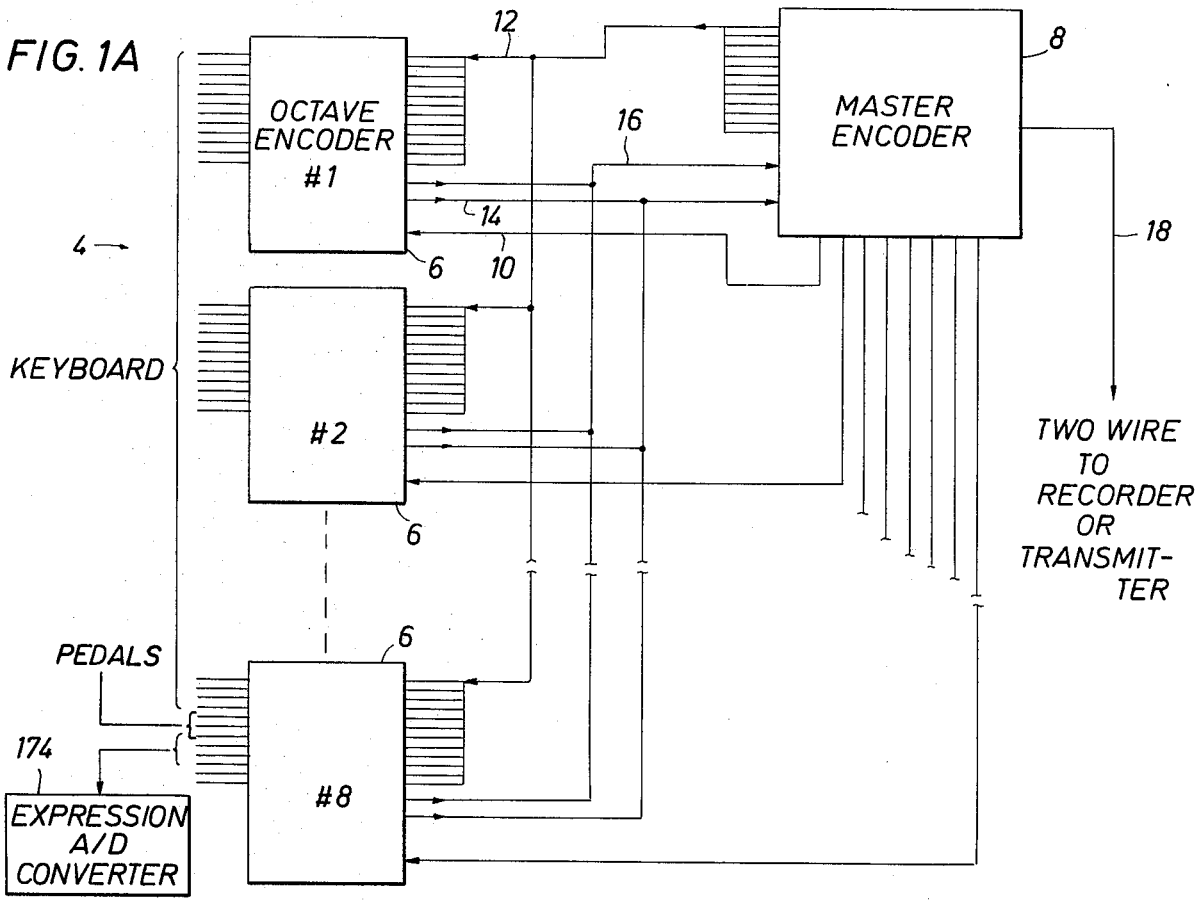
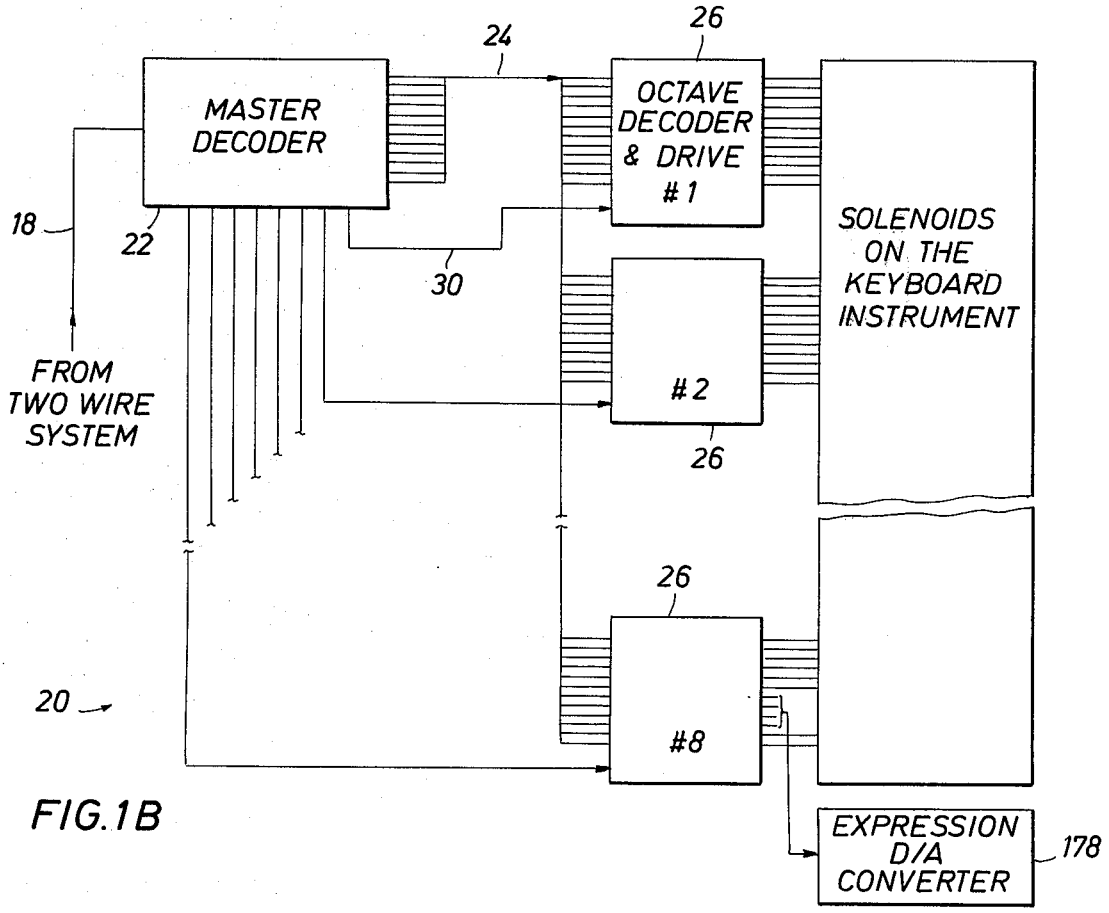
FIG. 1B

FIG. 2
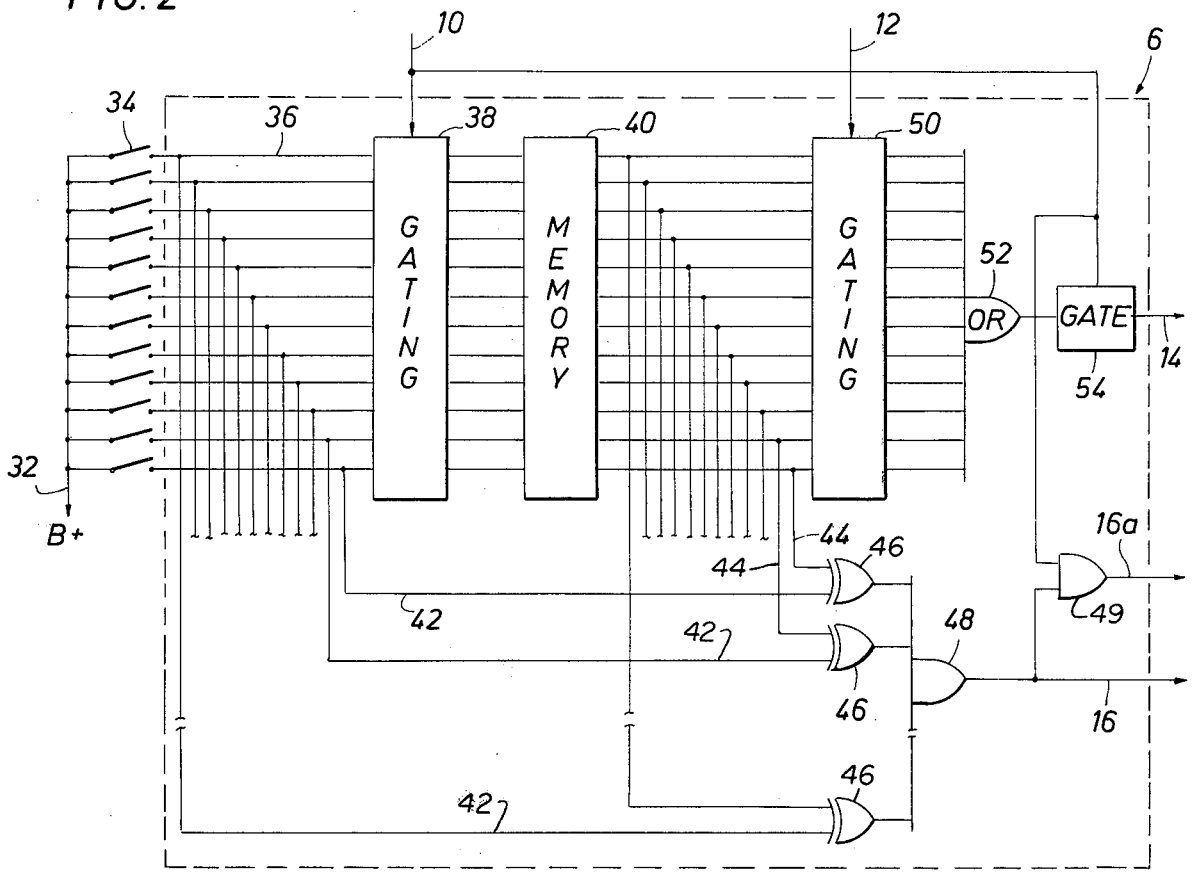
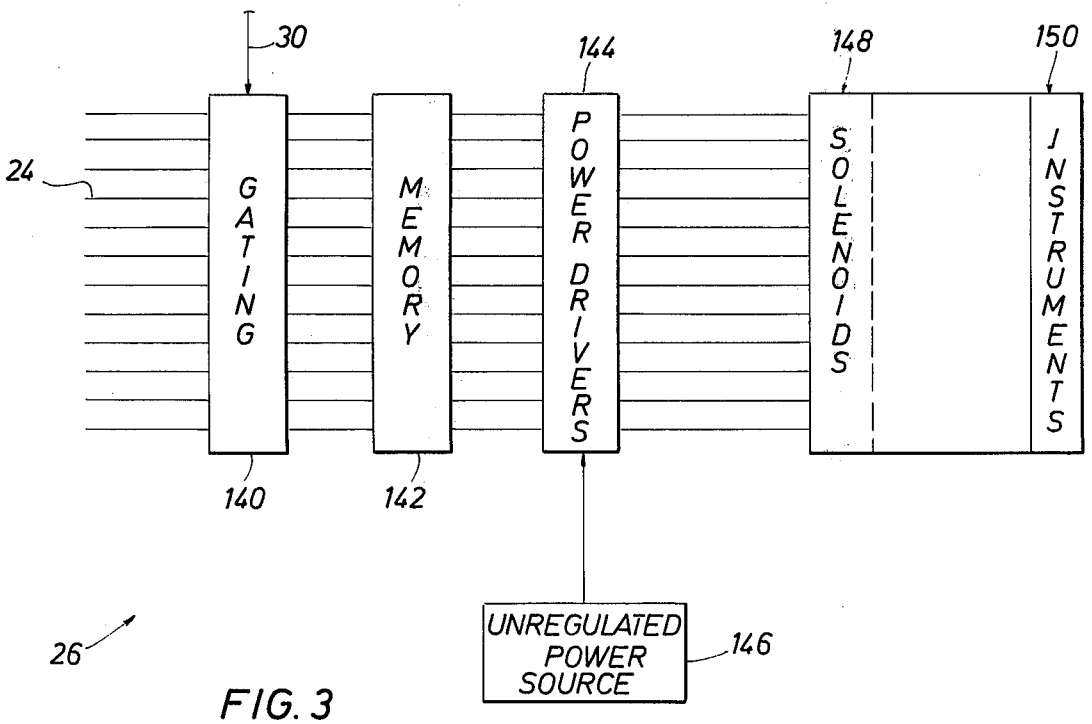
FIG. 3

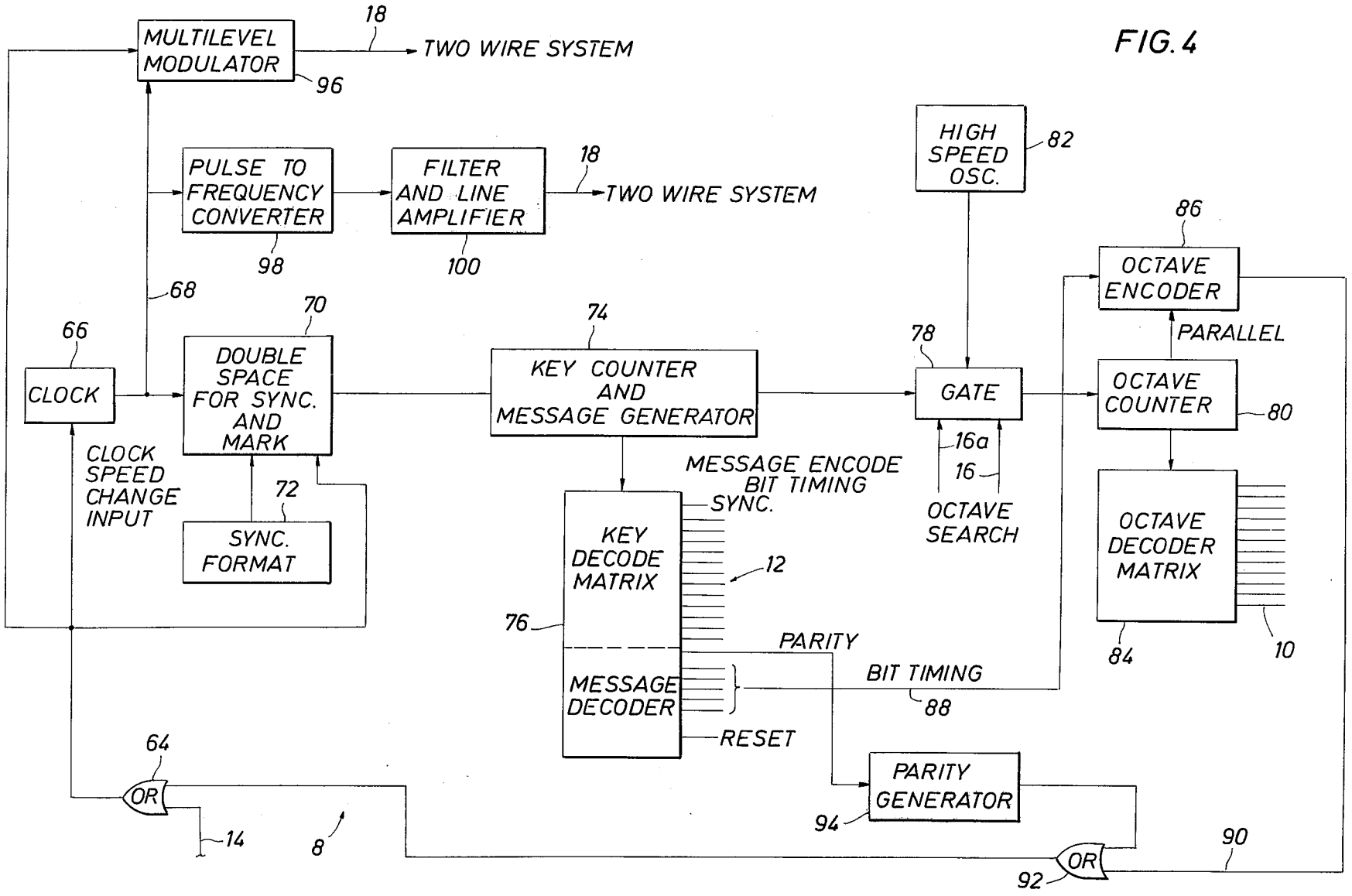
FIG. 4
OCTAVE ENCODER
PARALLEL
OCTAVE COUNTER
OCTAVE DECODER MATRIX
HIGH SPEED OSC.
GATE
OCTAVE SEARCH
BIT TIMING
PARITY GENERATOR
OR
MESSAGE ENCODE BIT TIMING
SYNC.
PARITY
RESET
KEY COUNTER AND MESSAGE GENERATOR
KEY DECODE MATRIX
MESSAGE DECODER
TWO WIRE SYSTEM
FILTER AND LINE AMPLIFIER
PULSE TO FREQUENCY CONVERTER
MULTILEVEL MODULATOR
DOUBLE SPACE FOR SYNC. AND MARK
SYNC. FORMAT
CLOCK SPEED CHANGE INPUT
CLOCK
10
12
14
16
16a
18
64
66
68
70
72
74
76
78
80
82
84
86
88
90
92
94
96
98
100
8

MUSIC ENCODING AND DECODING APPARATUS

BACKGROUND OF THE INVENTION

Player pianos utilize perforated paper tapes and a playback mechanism to provide recorded music. Of necessity, they are limited to the pre-recorded content. The paper tape is unrolled from a supply reel or spool past a set of fingers which locate the holes in the roll or tape causing the player mechanism to play the recorded melody. The old fashioned player piano invokes much nostalgia but it is limited in several regards. It is difficult for the owner to record his own music, and transmission of recorded signals is almost impossible. The only transmission that is actually available is by physical transfer of recorded paper tape. These limitations have materially constrained the use of player pianos except in a sentimental fashion.

The present invention is to be contrasted in many regards. It provides a device which forms a single channel output signal which can be transmitted over a two wire system using a multi-level modulator system or a bi-level transmission system transferring a minimum number of bits. Communication channels able to handle as low as about 2200 bits per second will suffice. This means that even telephone grade transmission systems are suitable for the apparatus without any degradation of performance. The apparatus defines an encoder and decoder which formats a signal having a minimum number of bits, thereby reducing the degree of sophistication and expense required in the device.

SUMMARY OF THE PRESENT INVENTION

The device of the present invention includes an encoder and decoder. It forms a message which can be recorded or otherwise transmitted by various techniques. The message encodes keyboard operation of a musical instrument. The keyboard is divided into preferably musically uniform groupings such as octaves. Other groupings such as fifths can be used. Either grouping is preferable since any transmission system has a given signal to noise ratio and a resultant bit error rate. Because tape recorded data with a "check-before-operate" method is not easily implemented, an error in decoding can occur. The groupings chosen should have a minimized discordant sound. The octave is most preferable with the fifth grouping producing some increase in the discordant sound on the occurrance of an error. Several octaves typically comprise a keyboard, therebeing 88 keys in a standard piano keyboard and typically 61 in most organ keyboards. The keys are equipped with a contact which is closed on actuation of the key. The elapsed time provides a measure of time which is related to the velocity of the key which is struck during playing or expression. The several octaves are interrogated in sequence except when one has been struck where a flag signal is formed. Each octave is uniquely scanned. Each key in a particular octave is encoded. A word is formed, typically for the whole octave and is formated for transmission. Gating and memory circuits ascertain a change of condition in a particular octave to form a flag signal. The scanning rate is calculated to exceed the performance of the human ear so that the listener does not hear any detectable change. The words which encode the keys which are struck include an expression encoding. The decoding apparatus reverses the function of the encoding apparatus.

DESCRIPTION OF THE DRAWINGS

FIG. 1A is a schematic block diagram of the encoding apparatus;

FIG. 1B is a schematic block diagram of a decoding circuit;

FIG. 2 is a schematic of an octave encode circuit;

FIG. 3 is a schematic diagram of an octave decode and drive circuit;

FIG. 4 is a schematic block diagram of a master encode circuit for use with several octave encode circuits of FIG. 2;

DESCRIPTION OF THE PREFERRED EMBODIMENT

Figure 5:
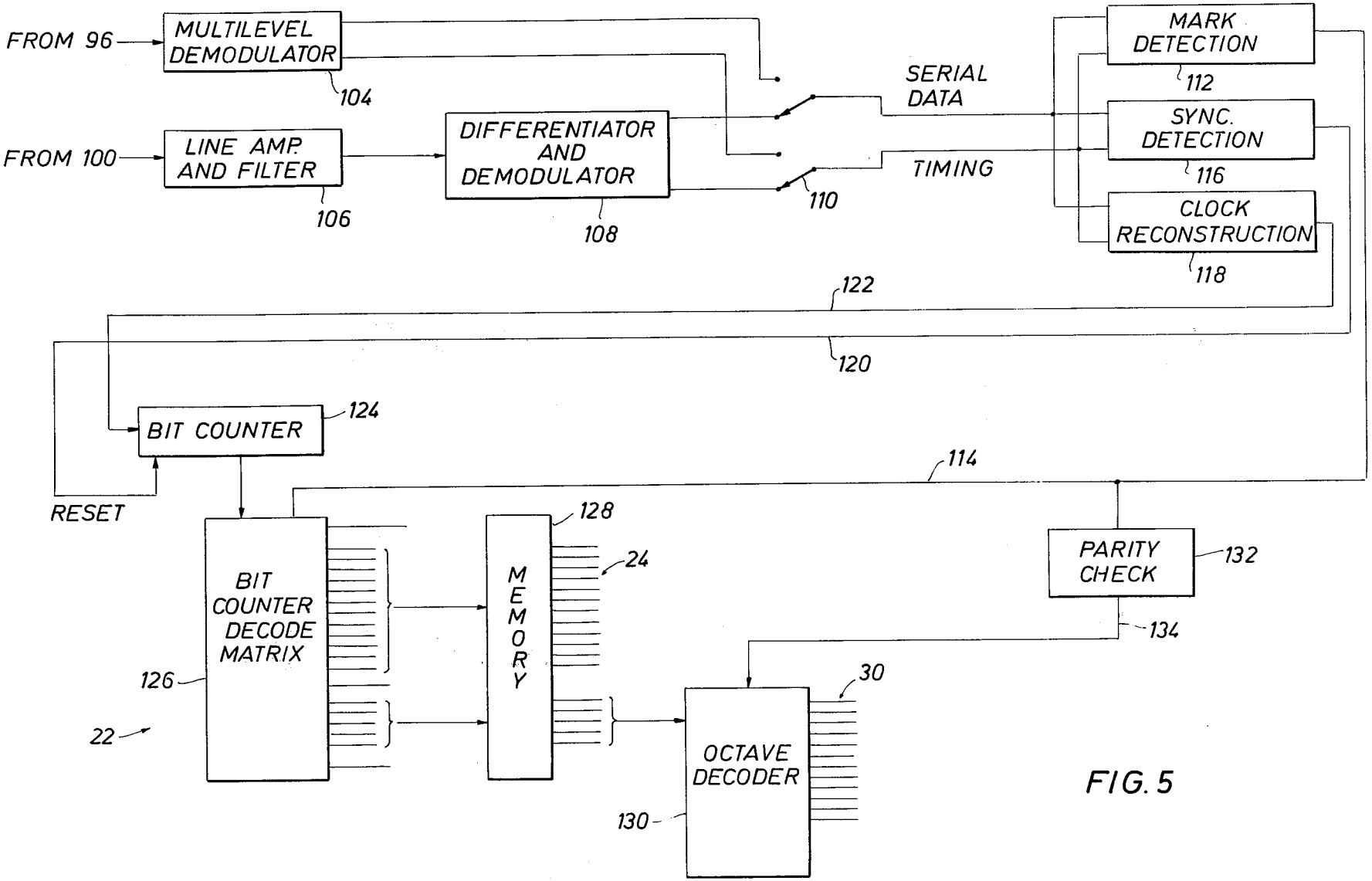
FIG. 5 is a schematic diagram of a master decode circuit for use with several decode circuits of the sort shown in FIG. 3.

Attention is first directed to the encoding apparatus 4 shown in FIG. 1A. The encoding apparatus includes a multiplicity of octave encode circuits indicated generally at 6. They preferably encode all the keys in an octave. An octave includes twelve semitones. The octave encode circuit 6 is duplicated for the requisite number of octaves. Eighty-eight keys are normally included in piano keyboards, and sixty-one keys are normally found on most organ keyboards. Regardless of the length of the keyboard, it is preferably divided into a number of logical groupings such as the twelve semitones which comprise an octave. One alternative is to use fifths. Other groupings can be specified, depending on the nature and organization of the instrument. Since the grouping is somewhat arbitrary, it can be varied although the most logical grouping is division into octaves. The circuit 6 is thus duplicated to the extent necessary to encode the entire keyboard. The octave encode circuit forms a signal for a master encoder 8.

FIG. 1A will be described that a typical piano is used. The last octave encode circuit 6 is not provided with a full complement of twelve signals. The three foot pedals are connected to it to be encoded. A signal source for expression is connected through one of the octave encoders to the extent that it has spare or unused inputs.

The encoder 8 provides an enable signal on a conductor 10 to each octave encoder 6. All of the encoders 6 are connected to the master 8 through a number of conductors 12. The encoders 6 are connected in parallel with one another through a common set of conductors. In a semitone octave, twelve conductors are included. They are bussed parallel to the several encoders 6.

The data from the octave encoder 6 is supplied on a conductor 14 to the master 8. Again, several are included and they are all connected in parallel. Appropriate enable signals avoid confusion of the signals from the various octaves on the line 14.

The device routinely scans a first octave, the adjacent octave, the next octave, and so on. In the case of a piano, it preferably starts at the lower end of the keyboard and encodes to the higher frequencies. Each octave is scanned and appropriate signals to be described are formed. The apparatus, however, includes a search line 16 which connects from the several encoders 6 to the master 8 by a conductor 16 which transfer a flag signal. The signal is a flag indicating that one of the other octaves had a change in condition meriting encoding. By way of example, suppose that the second octave has just been scanned and all the data from it encoded. The apparatus would normally then move on the third octave. During the time that the third octave is being scanned and under the presumption that a note was struck in the second octave, a flag signal is formed by the second octave circuit and placed on the conductor 16 to form a flag for the master encoder 8. The master circuit interrupts the routine scan sequence and returns to the second octave, rescans all of it, and captures the fresh data. This enables the apparatus to respond dynamically. The dynamics response is so rapid as to avoid time delay that can be detected by the human ear. It has been determined emperically that the human ear will interpret two notes as occurring simultaneously if they are struck within one hundred milliseconds of one another. This degree of interpretation will vary from person to person. Dependent upon the listener's ear, a reduction from one hundred milliseconds to twenty milliseconds reduces all semblance of a non-simultaneous striking of notes.

The master encoder 8 forms a signal on a conductor 18 which is communicated to a transmitter or recoding device. The signal is provided to decoder circuitry indicated generally at 20 in FIG. 1B which will be described very generally. It has a number of outputs matching the inputs to the master encoder 8. Again, if twelve keys are normally encoded by each circuit 6, it has the same number of outputs which are generally indicated by the conductors 24. They are connected in parallel with a number of octave decode and drive circuits 26. They are all preferably identical to one another. Signals on particular octave conductors 30 drive a selected octave decode and drive circuit 26. The octave driver circuit 26 is connected to a number of solenoids which electromechanically convert the signal into a note which is sounded.

For an understanding of how the circuitry described to this juncture operates, attention is next directed to FIG. 2 which shows the octave encode circuit 6 in greater detail.

In FIG. 2, a B+ bus 32 is connected to a contact carried by each key on the keyboard. Twelve are preferably connected to encode a full octave. The twelve key contacts are normally open so long as the keys are not depressed. When a key is struck, however, the signal is supplied from the conductor 32 to a typical key closure contact 34 through a conductor 36 which communicates with an enable gate 38. The gate 38 is provided with two inputs, one being on the conductor 36 for that particular key and the other being from the conductor 10. When a particular octave is interrogated, a signal is formed on the conductor 10 to that octave. This signal serves as an enable signal. Thus, each key has associated therewith an AND gate which is provided with an enable pulse. The pulse on the conductor 10 is applied to all of the gates connected to the key 34. They are all enabled simultaneously.

Each enable gate 38 is connected to a memory 40. The memory 40 stores the status of the signals provided from the key 34 when last enabled. The memory 40 is a flip-flop. The numerals 42 and 44 indicate two conductors from a single key contact 34. One is provided at the input of the enable gate 38 and the other is provided from the output of the memory 40. The conductors 42 and 44 are input to an EXCLUSIVE OR gate 46. The OR gate 46 forms a signal which indicates the occurrance of a change. For instance, if the key 34 remains unaltered, the signal on the conductors 42 and 44 will remain equal to one another. This can continue indefinitely. However, when a change has occurred, the gate 46 forms an output on a conductor supplied to a massive OR gate 48. The gate 48 is connected to the flag line 16. It forms a signal on the conductor 16 indicating that a change has occurred in the particular octave encoding circuit 6. The change in condition thus is a flag indicating the necessity of recognizing the change in status, encoding the change and transfer to the master encode circuit 8. The enable pulse on the conductor 10 and signal of the line 16 are both input to an AND gate 49 which forms a pulse **16*a*** indicating that a flag signal has been take down.

The numeral 50 identifies enable gates which are AND gates. They are each individually provided with signals resulting from operation of the key contact closure switches 34. The signals are each processed as described above through an enable gate 38 and stored in memory at 40. The memory gates sustain the signals to be stored. The memory gates 40 are each then input to the enable gates 50. The gates 50 are all provided with two inputs. One is from the particular memory 40 connected to it. The other is from one of the twelve enable conductors 12. In other words, the first key of the octave has an enable associated with the first conductor of the 12. The 12 gates are sequentially scanned. An enable signal is provided to the first, second, etc. As they are scanned, they are enabled to form output signals to a massive OR gate 52. The massive OR gate 52 forms an output signal when any of the keys in a particular octave are depressed. The signals from the gate 52 are in timed sequence in accordance with the enable signals from the conductors 12. The gate 52 is then connected to an enable gate 54. It is triggered by the signal on the conductor 10. A word is thus formed through the gate 54 for the time that it is enabled. The word is placed on the conductor 14. The conductor 14 is connected in parallel with similar output conductors from other octave encoders 6. However, because of the sequence of timing signals, only one set of signals is input to the conductor 14 at any instant. The output 14 of gate 54 is diode isolated to permit parallel connection.

Figure 6:
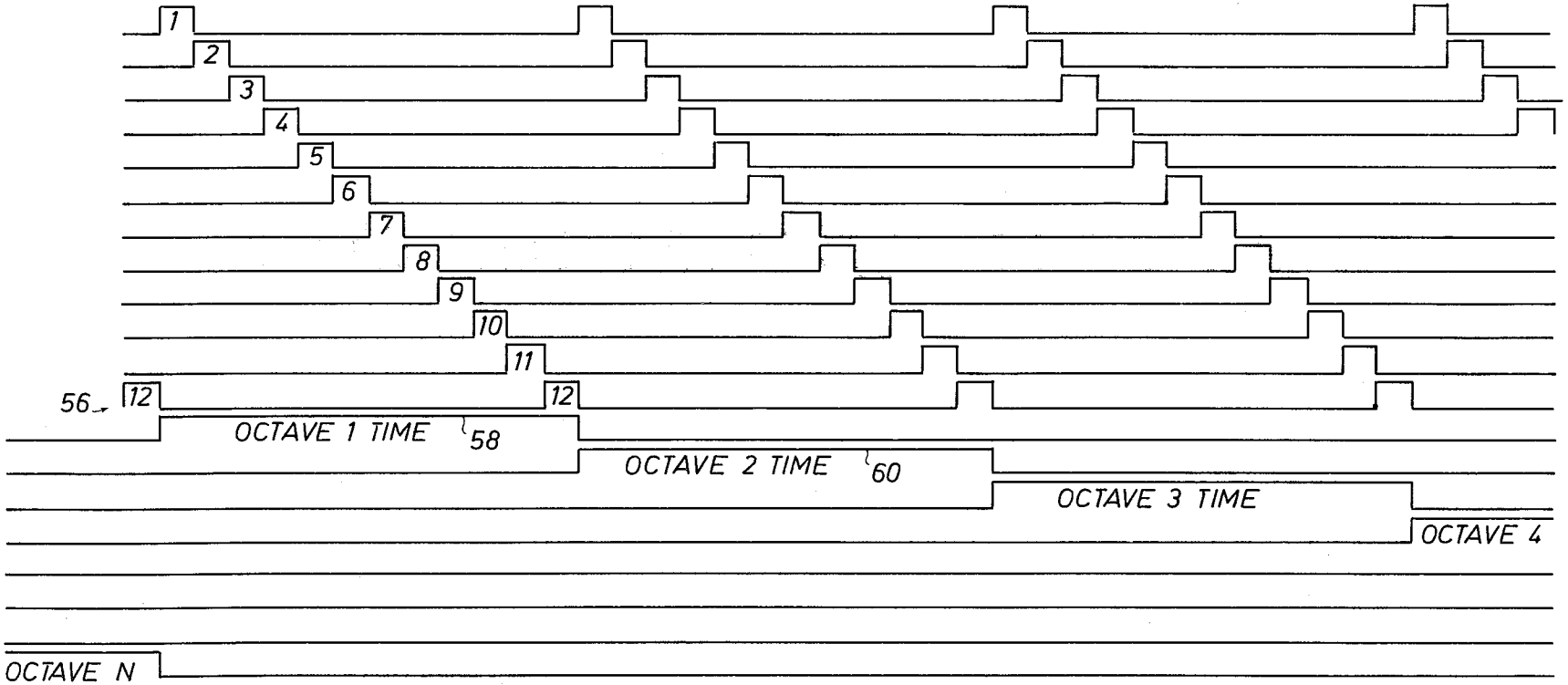
FIG. 6 is a timing chart of the encode and decode circuitry.

Attention is next directed to FIG. 6 of the drawings. Again, presuming that twelve keys are encoded at each circuit, twelve enable signals are shown at 56. The twelve occur in time sequence with one another. The numeral 58 identifies a different enable signal. Considering only the first octave which is encoded by the first encoder 6, the signal 58 is applied to the conductor 10 to that octave. The signals 56 are applied over the twelve conductors 12, each of a particular enable gate. If a key depression has occurred in that interval, this fact is encoded. If no key depression has occurred, there is no output signal for that particular key. By way of contrast, a second time octave signal is shown at 60. It is applied to the next octave encoder 6. This presumes, of course, that two or more are used, which is the normal case. The signals 58 and 60 are time relative to one another. A subsequent octave scan signal is also firmed after the end of the signal 60. Each signal 58 and 60 has a time span to permit the twelve lines 12 to have enable signals formed on them in the sequence is indicated at 56. The pattern 56 is repeated time and again, but each occurrance is tied with a particular signal 58 or 60. The number of octaves is designated as N and, the signals 58 and 60 occur in time sequence N times.

FIG. 4 shows the master encode circuit 8 in greater detail. A data word is formed in an individual octave encode circuit 6. It is input on the line 14 to an OR gate 64. It connects to a clock 66 which forms clock pulses. The clock 66 is provided with dual speeds which differ by a factor of two. Its output is to a conductor 68 which goes through certain modulation circuits to be described. The conductor 68 is input to a pulse shaping circuit 70 which takes the true and false signals from the clock 66 and stretches them as required by a synchronization format circuit 72 to form appropriately stretched true and false signals which are then input to a shift register 74. The shift register 74 receives pulses which are advanced. It is connected to a key decode matrix 76. The matrix 76 is a hard wired diode decode matrix which forms sequential signals. The first output signal is a synchronization signal. Next, it forms in sequence, signals for the enable gates 50 supplied over the conductors 12. Again, in the standard octave, twelve signals are formed. The conductors 12 thus extend from the decode matrix 76 to the several octave encoders 6 in the system. A parity line is included from the matrix 76.

A gate 78 is connected to the end of the register 74 and is advanced periodically. The rate of advance is proportionate. That is, the gate 78 is provided with an input signal only after the decode matrix 76 is operated through one cycle. A typical cycle of operation utilizes a word of about 20 bits beginning with a synchronization signal, twelve signals for the semitones, a parity bit, and the octave designation. Thus, the gate 78 is periodically advanced. It forms an input pulse which is supplied to an octave counter 80. The counter 80 keeps track of the particular octave which is being encoded. The octave counter 80 is advanced at a normal slow rate by pulses from the shift register 74. A high speed oscillator 82 provides rapid advance pulses through the gate 78 when a flag appears on the octave search line 16. The octave counter has a requisite number of states matching or exceeding the number of octave encoders 6. If there are eight octaves to be encoded, the counter has eight states. The eight states are temporarily stored in the counter 80 are three bits and they are decoded by an octave decode matrix 84. The decode matrix 84 is connected to the conductors 10. A single conductor is connected to each octave encoder 6 as previously described.

Operating at normal speed, an enable signal is formed on each of the conductors 10 in sequence. When a flag signal is formed on the octave search line 16, high speed pulses of the oscillator 82 are fed to the octave counter 80 which is advanced more rapidly. When the octave counter 80 is advanced at an increased rate, it still forms an output enable signal on the conductor 10 for the next occurring octave. If the prior enable signal had been on the third octave, the next would be formed on the fourth octave line 10. It is applied to the enable gates 38 of the particular octave encoder 6. If the application of the signal causes a change sensed at an EXCLUSIVE OR gate 46, the flag is taken away from the conductor 16 and a signal indicative of this change is also formed on the line 16*a*. This would occur where a key contact 34 had been altered in condition forming a signal recognized by the EXCLUSIVE OR gate. When the enable signal is provided to the particular octave encoder, the data stored in the memory gates 40 is altered after enabling to match that of the key contacts 34 and the signal from EXCLUSIVE OR gate ends. The enable signals on the lines 12 then are applied to the gates 50 and the condition of that particular octave is encoded and transferred on the conductor 14.

It is possible that operating at a high speed, the octave counter will scan through an octave which does not have a changed state. If this is the fact, the enable signal is applied to the conductor 10 for that particular octave but no change occurs at the octave search line 16. When this occurs, the flag remains on the line 16 and the counter 80 advances to another number, and a different octave is interrogated. All of this occurs while the synchronization pulse is being formed by the matrix 76. The counter 80 is operated rapidly and scans the requisite number of octaves during formation of the synchronization pulse. Normally, it has more than adequate time to scan from the last octave encoded to the one which forms the flag on the line 16.

Occasionally, two different octaves will have changes where they both form signals for the octave search line 16 as when a chord is struck. In this event, the enable signal supplied to line 10 drops the flag on the octave search line 16*a* when the first of two or more octaves having changes therein is interrogated. The apparatus encodes that octave and then at a high rate of speed, the counter 80 is advanced to find the next octave where a change had occurred. The next is found and a data word is encoded from it. If it removes the last flag signal from the line 16, the gate 78 disconnects the high speed oscillator 82 and the counter is then advanced at a normal rate. Scanning within an octave is always at a normal rate. In the event that still another flag remains for the gate 78, the counter 80 is still advanced rapidly until the source of the flag is found and interrogated. The line 16 causes octave searching at a high rate while the line 16*a* causes octave encoding at a normal rate.

The counter 80 assumes a state which is stored in the counter. Its condition is transferred to a parallel to serial encoder 86. After each change of state by the counter 80, a timing signal from a conductor 88 triggers the encoder 86 to convert the count of the particular octave in the counter 80 to a serial set of bits which are supplied through a conductor 90 to an OR gate 92 which is input to the OR gate 64 previously mentioned. Twelve bits are input on the conductor 14 representing the status of the twelve keys in the particular octave. The OR gate supplies the remainder of the word to be encoded for a particular octave. The remainder of the word includes the several bits which identify the particular octave where the twelve bits originated and further include a parity bit from a parity generator 94 input to the OR gate 92. All of the sources of information for one complete word are input to the OR gate 64.

The gate 64 drives the clock 66. The OR gate 64 is connected directly to a multi-level modulator 96 which forms output signals for a two wire system using phase shift, quadraphase or other type of modulation. This type modulation is ideal for phone lines and the like. An alternative is incorporated where the pulses are applied to a pulse to frequency converter 98. Bi-level signals are generally defined as mark and/or spaces as opposed to the designations phase 1, phase 2, phase 3 and phase 4 in a quadraphase system. It forms signals for a filter and line amplifier 100 which drives a tape recorder or some two wire system.

Attention is next directed to FIG. 5 which shows the master decoder 22. Inputs from the modulators 96 or 100 are provided, and one is selected. The apparatus functions with either type of transmission system, and this is considered to be a major improvement over any known prior art system. A multilevel demodulator 104 is provided with the input 96 while a line amplifier and filter 106 is supplied with the output from the line amplifier 100 previously mentioned. The filter 106 provides an input for a differentiator and demodulator 108. A switch 110 selects between the two types of data which are described in the alternative, one of which is incorporated in the equipment. Entry of data is detected by a means 112. It responds to the entry of a mark or true level. An output signal is formed on a conductor 114. The asynchronization pulse is found by a detection circuit 116. A clock 118 is incorporated, capable of running at the time rates of the clock 66. It is gated between the two clock rates by the signals applied to it. The asynchronization detector 116 forms an output signal on a conductor 120 while clock pulses are formed on a conductor 122. The asynchronization pulse on the line 120 serves as a reset signal. The line 122 supplies clock pulses to a bit counter 124 which is reset by the signal on the line 120.

The bit counter 124 is driven by signals from the counter. As the bits are advanced to the counter and stored temporarily, a bit counter decode matrix 126 is driven by the counter 124 and forms a number of outputs which are then supplied to a buffer memory 128. The buffer memory is provided with driving signals for the twelve keys in a particular octave. It is also provided with the bits which identify the particular octave which is to be driven. The buffer 128 supplies signals on the conductors 24 which are connected in parallel to the octave driver circuits 26 which will be described. A portion of the buffer memory 128 provides the requisite three or four, or more, bits for identification of a particular octave which has been encoded. This data is supplied from the buffer memory 128 to an octave decoder 130.

The data supplied from the mark detector 112 on line 114 is input to a parity check circuit 132. The parity circuit forms an enable signal on a conductor 134 which drives the octave decoder 130. If parity does not check, no enable signal is provided and that particular data word input to the counter 124 is decoded but nothing is driven and hence it is rejected. The apparatus goes on to the next data word. The speed of operation of the present invention is sufficient that discarding a word for failure of parity is not heard by the listener. It must be kept in mind that a data word is formed for octaves in sequence with no flag, resulting in updating of all octaves rapidly, even after a word is discarded for failure of parity.

The octave decoder 130 forms signals on the conductors 30 which enable a particular octave. If the octave which was encoded is the third octave, this is recognized by the decoder 130 and a signal is formed on the one of the lines 30 supplied to the third octave.

The output of the master decoder 22 comprises signals on the conductors 24 and signals on the conductors 30. The conductors 24 are common to all octaves. An individual line 30 is connected to each octave.

In FIG. 3, the octave driver circuit 26 is shown. The twelve lines 24 are input to an equal number of enable gates 140. A single AND gate is associated with each key. The gate has two inputs, the line 30 for that particular octave being the enable line for all of the gates. A memory circuit 142 is provided for each of the twelve keys. The memory circuit 142 is preferably a flip-flop. It sustains the gated signal after the enable signal on the conductor 30 is removed. The memory circuit 142 drives a power amplifier circuit 144 which is provided with power from a source 146. The source 146 might preferably be unregulated. It is not necessary to be more precise. Some advantage is obtained by lack of regulation as will be discussed hereinafter.

The power drivers 144 drive solenoids 148 which are connected to the musical instrument 150. In the case of a precussion type instrument such as a piano or harpsichord, the solenoids drive the hammer which strikes the string. In other keyboard instruments such as an organ, they operate the keyboard to provide keyboard signals for gating of various pipes, valves, or stops in electronic or pipe organs.

The use of an unregulated source 146 more nearly simulates the expression. For instance, if two or three keys in a particular octave are struck simultaneously, the force or power with which the piano keys are struck is somewhat less than when fewer keys are struck. This is simulated by a slight drop in solenoid voltage. The drop in solenoid voltage provides less power to the solenoids and they do not operate as crisply as would be the case where only a single solenoid is actuated. The degree of unregulation is best controlled.

Figure 7:
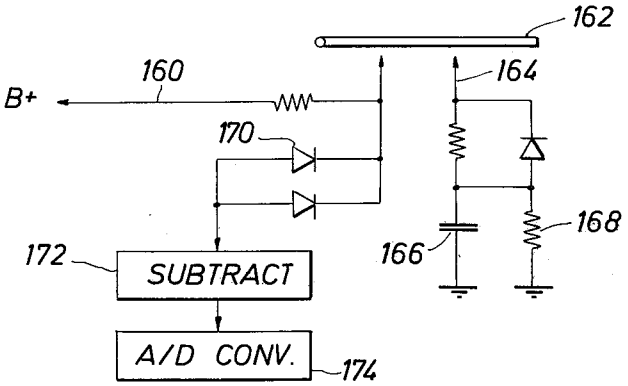
FIG. 7 is a schematic of one form encoding circuitry for obtaining a measure of expression; and, FIG. 8 is a schematic block diagram of an expression encode circuit.

Attention is next directed to FIG. 7 of the drawings. It shows a means for obtaining expression which can be particularly important in a precussion keyboard instrument. A B+ line 160 is connected to a terminal on a particular key 162. Each key is appropriately equipped with a B+ source. As the key is struck, it swings towards a contact 164. The key has a velocity which is determined by the force with which it is struck. Its duration of contact with the terminal 164 is thus related to the velocity of the key. The harder the key is struck, the less contact it achieves with the terminal 164. The slower it travels, the greater is the duration of contact. The terminal 164 is connected to a storage capacitor 166. The charge on it is accumulated from the B+ source 160. As the key moves by rapidly, only a small charge is accummulated. If its moves slowly, a larger charge is accumulated. The charge is bled slowly to ground through a resistor 168. The bleed rate is substantially slow in comparison with the accummulation rate of charge of the capacitor 166.

The circuit described to this juncture is provided for each key. Several keys are found in a group, typically an octave. The charge on the capacitor 166 is supplied through a diode 170. The largest signal is passed by the diode 170 and supplied to a subtract circuit 172. This subtract circuit provides a level from which the signal from the OR gate 170 is subtracted. The output is an analog signal provided to an A – D convertor 174.

Expression levels beyond sixteen increments cannot hardly be heard by the human ear. As a consequence, the A – D convertor 174 forms only a four bit expression word. The expression word represents the expression for that particular octave. It normally encodes the expression of the key which was struck the hardest in the octave. To the listener, expression suitable for the keys struck the hardest is normally sufficient for the other keys in the octave. However, individual key expression is the rule because simultaneous key striking is rare in view of the speed of the encoding system.

The circuitry shown in FIG. 7 is duplicated for each octave for a designated portions of the keyboard or for the single keyboard. It can be duplicated for each key although this is needlessly expensive. The A – D convertor 174 forms an expression word which is input to an octave encoder shown in FIG. 1A. It will be recalled that routinely one octave is not fully used and any spare inputs on any octave are suitably adapted for transfer of the expression word.

The expression word which is input to one encoder in FIG. 1A is recovered from one of the decoders 26 shown in FIG. 1B. The expression signal is supplied to a D – A 178. For an understanding of transmission of the expression, attention is directed to FIG. 8.

Figure 8:
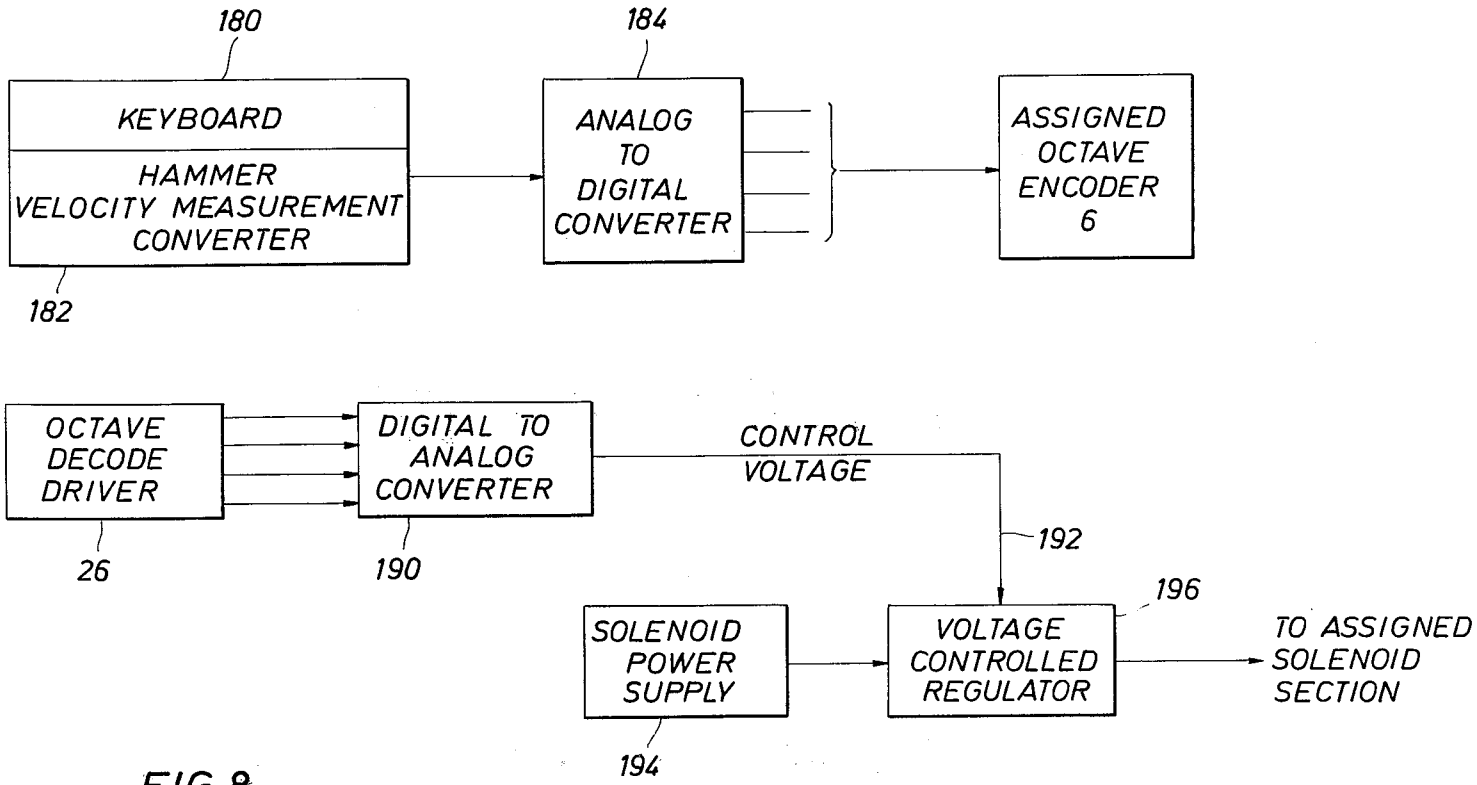

FIG. 8 discloses a system which provides expression which is encoded and subsequently decoded. In FIG. 8, the keyboard of the encoding instrument is indicated at 180. The apparatus of the sort shown in FIG. 7 is used to encode the force with which a key is struck or depressed. It is indicated at 182. The signal is preferably an electrical analog signal representing the value of velocity for a designated section of the keyboard which is measured. One such measurement can be obtained for the entire keyboard, each octave, or any other designated groupings of the keyboard. The signal is supplied to an A – D convertor 184. This is consistent with the teaching found in FIG. 7. The signals from the converter 184 are applied to one of the octave encoder circuits 6 as previously described.

At the decode end, the expression word is obtained from a decode driver 26 and supplied to a D – A converter 190. It forms a control voltage on a conductor 192. A common solenoid power supply 194 drives all of the solenoids. Its output is supplied through a voltage control regulator 196. The voltage is controlled by the signal on the conductor 192. The regulator 196 drives the appropriate solenoids with a voltage having a level selected by the regulator 196.

The solenoid voltage is dropped when a softer note is required. The driving voltage is increased when a louder note is required.

When a note is sustained, the apparatus scans through the octave where the note is located and a new driving signal for that note is formed. The signal is encoded and subsequently decoded by the apparatus shown in FIG. 1A. The solenoid for that particular note electromechanically integrates the the newly repeated driving signal. In other words, a long note will be found and encoded several times but it is only sounded once. Restated, the several encoding signals associated with that particular note are merely cumulative when applied to the solenoid driving that particular note. In a precussion keyboard instrument, the hammer for the precussion instrument is swung by the first driving signal to the solenoid. Subsequent driving signals do not alter the hammer action thereafter because it cannot be driven any further by later signals. The fact that a subsequent signal is applied to the memory is meaningless. The solenoid thus effectively integrates driving signals applied to the sustained note without creating an unwanted bump or modulation of note intensity. In other keyboard instruments such as a pipe organ, the solenoid operates an air valve which again is sustained, achieving integration of multiple signals for that particular note without creating a bump or modulation in the signal.

An alternative technique of encoding expression is to utilize two contacts under each key where the apparatus shown in FIG. 2 is duplicated. When the key is struck, encoding is achieved at the first contact. A second and lower contact is subsequently struck. This also is encoded. The time lag between striking the two contacts under each particular key is related to the expression. A softer note has an increased time lag. The time differential measured at the decoder is thus inversely proportional to the expression. A short or small time differential is associated with the louder note. Through this technique, expression for each key can be obtained. The expression can be provided to the driving solenoid through the use of a voltage controlled regulator which is driven by the inverse of the time differential measured from the two encoded signals for the particular key.

It is believed that the foregoing description of operation and construction of the apparatus has fully set forth its mode of operation and use. It is particularly adapted for providing a signal for tape recording. It is designed for compatibility with any state of the art communication system. A suitable data rate enabling encoding of the most dynamic sort of music without detection of any degradation by the human ear can be achieved with as few as about sixteen scans per second of the entire keyboard with the octave search feature included. With this scanning rate, about 2200 bits per second are created. Data transfer techniques for handling 2200 bits per second are readily available including transmission over telephone quality lines. It is submitted that the apparatus provides a signal which is easily handled in contrast with that of competitive devices. The easily handled signal enables the present invention to receive and encode keyboard music of the most complex sort without any degradation without play back and loss of fidelity in transmission or recording.

The foregoing is directed to the preferred embodiment but the scope is determined by the claims which follow.

I claim:

1. Apparatus for forming a representation of playing a music instrument comprising:

first means responsive to a struck note on a selected portion of an instrument, the instrument being divided into two or more selected portions and therebeing a first means associated with each of the portions of the instrument and said first means scanning a specified number of potential notes in the selected portion of the instrument and forming a signal indicative of a musical change in the selected notes; and, a master circuit means connected to at least two of said first means for forming an output signal identifying which of said first means has a signal indicative of a musical change and also including a signal indicative of the change; said signal having a multibit format suitable for transmission and decoding.

2. The apparatus of claim 1 including three of said first means, and a second means in said master means for sequentially interrogating said first means in a designated sequence and causing said first means to reply to said interrogation with a multibit data word which represents its musical changes.

3. The apparatus of claim 2 including a third means forming a signal indicative of a musical change from each of said first means, said third means being connected to said master means which thereupon interrogates said first means in an altered sequence to find which of said third means has formed its signal.

4. The apparatus of claim 3 including a fourth means in said master means which causes said first means to encode its musical changes into a multibit word.

5. The apparatus of claim 1 wherein said first means includes, for a single note which is actuated by playing the musical instrument, an enable gate connected to a voltage source which is co-extensive with use of the single note, a memory connected to the output of said gate, and an EXCLUSIVE OR gate having two inputs, one being from the output of said memory and the other from the single note to form a note change signal from said OR gate.

6. The apparatus of claim 5 wherein said note change signal is supplied to said master circuit means which includes a means responsive to said note change signal to form an enabling signal supplied to said enabled gate which transfers into said memory a signal indicative of the change of the musical note, and including a circuit means gating the contents of said memory to said master circuit means which forms, for said first means, a multibit data word including a binary encoded representation of said note change signal.

7. The apparatus of claim 1 including a register means in said master circuit means for receiving and storing a binary representation of said first means for each note in the selected portion thereof, and also including means forming a binary representation of the particular first means where said register means periodically forms an output word including both binary representations.

8. The apparatus of claim 1 wherein said first means exceeds three, and said master circuit means includes means for interrogating said first means in a designated sequence; and means for interrogating said first means out of sequence when a note change occurs in a particular first means.

9. The apparatus of claim 8 wherein said master circuit means includes an enable line to each of said first means, and a sequential enable signal generator connected to said enable lines, and a means for operating said generator at two rates of speed, one of which is faster so as to enable said first means rapidly until one of said first means is found to have a changed musical note whereupon that first means is interrogated and the data thereof is transferred to said master circuit means by said enable means.

10. The apparatus of claim 1 including master decode means provided with the output signal from said master circuit means;

a plurality of solenoid drivers connected to a musical instrument to be played;

at least two solenoid driver means organized into portions which are the same as portions of said first means; and, second means connected to said solenoid driver means from said master decode means which transfers enable signals periodically to said solenoid driver means and also transfers musical note signals, when enabled, to said solenoid driver means which power said solenoid drivers selectively to sound a musical note.

11. The apparatus of claim 10 including a buffer circuit means for storing the output signal of said master circuit means, and a decode matrix connected thereto to uniquely drive said solenoid drivers on deciding through said solenoid driver means.

12. The apparatus of claim 10 including a plurality of solenoid driver enable circuits in each of said solenoid driver circuit means; and a plurality of enable lines from said master decode means to said solenoid driver means.

13. The apparatus of claim 1 for use with a keyboard instrument and including means for encoding the expression of the struck note into a multibit digital signal.

14. The apparatus of claim 13 including a means for forming a signal related to the velocity of a note striking apparatus of the musical instrument which signal is supplied to said encoding means.

15. The apparatus of claim 14 wherein said signal forming means is duplicated for each note.

16. The apparatus of claim 13 wherein the means named in claim 13 includes an analog to digital converter.

17. The apparatus of claim 16 wherein the digital to analog convertor forming a control voltage for a power supply which is selectively connected to a solenoid driver which powers a solenoid which sounds a note with expression.

18. The apparatus of claim 1 wherein the output signal of said master circuit is placed in a recording medium.

19. The apparatus of claim 1 including a playback means which is responsive to the multibit signal for use with a musical instrument to be played which playback means plays the musical instrument by reproducing the notes played in sequence.

* * * * *